United States Patent [19]

Shimamura et al.

[11] 4,043,814

[45] Aug. 23, 1977

[54] IMAGE INTENSIFICATION

[75] Inventors: Isao Shimamura; Koichi Nakamura, both of Minami-ashigara, Japan

[73] Assignee: Fuji Photo Film Co., Ltd., Minami-ashigara, Japan

[21] Appl. No.: 629,444

[22] Filed: Nov. 6, 1975

[30] Foreign Application Priority Data

Nov. 6, 1974 Japan ..... 49-128327
Dec. 4, 1974 Japan ..... 49-139917

[51] Int. Cl.[2] ..... G03C 7/00; G03C 5/24; G03C 5/32

[52] U.S. Cl. ..... 96/10; 96/48 PD; 96/60 R

[58] Field of Search ..... 96/10, 76 R, 108, 60 R, 96/95, 48 PD

[56] References Cited

U.S. PATENT DOCUMENTS

| | | | |
|---|---|---|---|
| 2,515,930 | 7/1950 | Seary | 96/66 |
| 2,611,699 | 9/1952 | Zappert | 96/66 |
| 3,240,598 | 3/1966 | Johnson | 96/60 R |
| 3,700,456 | 10/1972 | Smith | 96/76 R |
| 3,748,130 | 7/1973 | Hoffman et al. | 96/95 |
| 3,825,425 | 7/1974 | Heilmann | 96/60 R |
| 3,829,549 | 8/1974 | Anderson et al. | 423/46 |

OTHER PUBLICATIONS p. 209, Cond. Chem. Dictionary, Reinhold Publ., 1966, Rose.

*Primary Examiner*—David Klein
*Assistant Examiner*—Louis Falasco
*Attorney, Agent, or Firm*—Sughrue, Rothwell, Mion, Zinn and Macpeak

[57] ABSTRACT

An image-forming method, which comprises contacting at least one member selected from the group consisting of chlorite, chlorous acid, chlorine dioxide water, bromite and bromous acid with a photographic element comprising a support having provided thereon at least one layer containing image-wise distributed catalyst nuclei in the presence of a developing agent to thereby conduct image intensification.

24 Claims, No Drawings

IMAGE INTENSIFICATION

BACKGROUND OF THE INVENTION

1. Field of the Invention

The present invention relates to an image-forming process and an image-recording material. More particularly, it relates to a process for the intensification of images by an oxidationreduction reaction using at least one of chlorous acid, chlorite, chlorine dioxide water, bromite and bromous acid. Still more particularly, in an especially preferred embodiment it is concerned with a photographic image-recording material containing a photographic color former in a greater amount than the stoichiometric amount based on silver, and to a process for intensifying the images thereof.

2. Description of the Prior Art

In the field of color photography to which the present invention is applicable, cyan, yellow, magenta and like color formers are incorporated into a silver halide emulsion by various processes, and color photographic materials prepared by coating the resulting emulsion on a support are subjected, after imagewise exposure, to a series of processings to reproduce images on the photographic materials.

Fundamental steps in the processings are a color-developing step and a silver-removing step. That is, silver halide contained in an exposed silver halide color photographic material is reduced with a color developing agent in the colordeveloping step to produce silver, whereas oxidized color developing agent reacts with a coupler to provide dye images. Then, the color photographic material is subjected to silver-removing. After oxidizing silver, produced in the preceding step by the action of an oxidizing agent (usually called a bleaching agent), oxidized silver is dissolved away with a silver ion-complexing agent (usually called a fixing agent), and is thus removed from the photographic material. Accordingly, only a dye image is formed in the photographic material.

In actual development processing, auxiliary steps to maintain the photographic and physical properties of images or to improving the preservability of images are generally used in addition to the above-described two fundamental steps (color-developing and silver-removing). For example, there can be illustrated a hardening to prevent the light-sensitive film from being softened too much during processings, a stopping to effectively stop the development reaction, an image-stabilizing to stabilize images, delaminating a backing layer on a support, and the like.

This type of processing for color photographic materials has been commonly conducted in this field since the 1940's on a world-wide scale.

Color light-sensitive materials used for such a color processing generally contain about 1 g to 15 g of silver per $m^2$ of support as silver halide. For example, most reflection image materials (color papers) contain 1 to 2.5 g of silver per $m^2$, and most photographic materials such as color negative films and color reversal films contain 3 – 9 g silver per $m^2$. This amount of silver is necessary to obtain the required color image density. However, from the viewpoint of saving silver and lowering production cost, a reduction in the amount of silver would be of great merit.

Various attemps have been made to reduce the amount of silver in light-sensitive materials while obtaining sufficient color density. For example, there are known processes of using a 2-equivalent coupler whose oxidation equivalent in the dyeproducing reaction is 2 (described in, for example, U.S. Pat. Nos. 3,253,924, 3,591,383, 3,311,476, 3,458,315, 3,476,563, 3,419,391, Japanese Patent Application 56,050/73, U.S. Pat. Nos. 3,369,895, 3,408,194, 3,415,562, British Pat. Nos. 1,040,710, 1,302,398, West German Pat. No. OLS 2,213,461, Japanese Patent Application No. 3,039/72, etc., using an auxiliary agent so as to raise the extinction coefficient of the color images (West German Patent OLS No. 2,238,051), and increasing the amount of dye produced by a halogenation-bleaching silver deposit (produced by color development) and again conducting color development (e.g., U.S. Pat. Nos. 2,439,901, 2,623,822, 2,814,565 and 3,372,028). The present invention relates to an improvement in processes belonging to the last-mentioned class, i.e., involving repeated color redeveloping.

In generally conducted color image-producing processings, reduction of silver salt and oxidation of a color developing agent take place and the oxidized developing agent in turn reacts with a coupler to form dye images. Therefore, the silver salt is used only once. On the other hand, in repeated color redeveloping, silver deposits are converted to silver halide through halogenation-bleaching, and color development is again conducted to thereby increase the amount of dye produced.

This process should be very advantageous since the silver halide in a light-sensitive material is theoretically used repeatedly. Actually, however, it has not yet been put into practice due to various restrictions. The restrictions include, firstly, the fact that an oxidizing agent used in re-halogenation bleaching remains in the emulsion film and causes bleach fog, i.e., oxidation coloration at silver salt-free areas, in the step of color redevelopment, thus seriously spoiling image quality.

Secondly, there is the disadvantage of an increased number of processing steps and disadvantages resulting therefrom. One color re-development requires a fixing step, a re-halogenation bleaching step, a color redeveloping step, 2 to 3 washing steps and, desirably, a clearing bath, i.e., 5 to 7 steps in all in addition to ordinary processing steps. Therefore, the processing requires much time, which leads to disadvantages such as a reduction of the physical strength of an emulsion film, troublesome administration of processing solutions and increased chemicals costs.

Thirdly, there is the defect that, since re-halogenation bleaching is conducted prior to color re-development, the color developer is liable to be deteriorated.

Fourthly, since a strong ferricyanide bleach is used for re-halogenation bleaching, an environmental pollutant is present in the waste water, and therefore measures to remove the same become necessary.

Fifthly, the color images produced are likely to be destroyed through oxidation.

On the other hand, U.S. Pat. No. 3,674,490 describes a novel process for reducing the amount of silver halide in a light-sensitive material through a novel color intensifying process. According to this specification, imagewise distributed nuclei function as a catalyst for a peroxide compound, such as hydrogen peroxide, to initiate an oxidation reaction, and dyes are produced as a result of the oxidation reaction, thus forming color images. Since nuclei are required only as a catalyst, only a small amount of nuclei are necessary. Therefore, when silver is used as the nuclei, the intended color density can be attained by using silver salt in a much lower amount than that of the silver salt used in a conventional silver salt gelatin emulsion. In this process, a peroxide is used in the intensifying step provided after the developing step (color development). However, this process involves many defects. Firstly, peroxides, e.g., hydrogen peroxide, are extremely unstable in aqueous solution. Secondly, an increase of the intensifying time leads to a destruction of dye images. Thirdly, the intensifying causes fog.

On the other hand, U.S. Pat. No. 3,765,891 describes, as a novel intensifying process, a process of forming dyes by oxidation-reduction reaction with a cobalt (III) complex salt, e.g., by hexamminecobalt (III) chloride, using image-wise distributed nuclei as a catalyst. This process is superior in that cobalt (III) complex salts are more stable than peroxides. However, this process has the defect that, as compared with conventional intensification using peroxides, the degree of intensification is low.

SUMMARY OF THE INVENTION

An object of the present invention is to provide a process for forming dyes by an oxidation-reduction reaction using image-wise distributed nuclei as a catalyst.

Another object of the present invention is to provide an intensifying step having high dye-forming capability.

A further object of the present invention is to provide an intensifying step which causes only slight fog.

Still a further object of the present invention is to provide an intensifying step which results in no destruction of dye images.

Still yet a further object of the present invention is to provide an intensifying agent which provides an intensifier of excellent stability.

Yet another object of the present invention is to provide a process for reducing the amount of silver salt required in a silver-salt-color light-sensitive material.

Yet a further object of the present invention is to provide an image-forming process capable of providing sufficient color density even when the amount of silver halide is reduced.

The above-described objects of the present invention can be attained by intensifying images with at least one member selected from the group consisting of a chlorite, chlorous acid, chlorine dioxide water (aqueous solution of $ClO_2$), a bromite and bromous acid, using a photographic element comprising a support having provided thereon at least one layer containing image-wise distributed catalytic nuclei in the presence of a reducing agent.

DETAILED DESCRIPTION OF THE INVENTION

The chlorites or bromites used in the present invention are the alkali metal salts (e.g., lithium salt, sodium salt, potassium salt, etc.), alkaline earth salts (e.g., magnesium salt, calcium salt, strontium salt, barium salt, etc.) and ammonium salts of chlorous acid or bromous acid. In particular, sodium chlorite, potassium chlorite, sodium bromite and potassium bromite are preferred.

Chlorite, chlorous acid, chlorine dioxide water, bromite or bromous acid is incorporated in a processing solution and/or a light-sensitive material. Particularly, it is preferred to incorporate them in a processing solution. In the case of addition to a processing solution, addition can be to a bath (an intensifying bath) provided after developing and before silver-removing (bleaching and/or fixing) and/or to a developer. Alternatively, addition can be to pre-developing bath. Generally speaking, it is preferred to add these materials to an intensifying bath.

The primary characteristics of an intensifier bath are that it contain alkali in an amount to adjust pH of the intensifying bath to 7 to 14 and a conventional pH buffer (1 to 100 g/1) to avoid undue pH changes. The intensifying bath is preferably used at a temperature of 10° to 90° C, most preferably 20° to 70° C, and intensification is conducted for from 5 sec. to 20 min, most preferably 10 sec. to 10 min. No need exists to intensify at other than atmospheric pressure.

In the case of addition to a processing solution, chlorite, chlorous acid, chlorine dioxide, bromite or bromous acid is used in an amount of 0.01 to 6 mol/1, preferably 0.02 to 4 mol/1, most preferably 0.05 to 3 mol/1. This generally corresponds to 1 g to 600 g, preferably from 2 g to 400 g, and more preferably from 5 g to 300 g, per liter of processing solution. In the case of an intensifier bath, the pH of the intensifier ranges from 7 to 14, preferably from 8 to 13. The intensifier bath can contain known developer components, e.g., an alkali agent, a buffer agent, etc., e.g., sodium hydroxide, potassium hydroxide, sodium carbonate, potassium carbonate, sodium or potassium tertiary phosphate, potassium metaborate, borax, and the like, alone or in combination. Also, in order to impart a buffering capability or for ease of preparation or to raise ionic strength, there can be used, in addition, various salts such as disodium or dipotassium hydrogen phosphate, sodium or potassium bicarbonate, boric acid, alkali nitrate, alkali sulfate, etc.

In the intensifier bath there can be presented a conventional amount of an anti-fogging agent, if desired. Typical examples of anti-fogging agents are alkali bromides such as sodium bromide, potassium bromide, ammonium bromide, etc. In addition, inorganic halide compounds such as potassium iodide or sodium iodide and known organic anti-fogging agents can be used.

As examples of the latter, there are hetero ring compounds represented by 6-nitrobenzimidazoles described in U.S. Pat. No. 2,496,940, 5-nitrobenzimidazoles described in U.S. Pat. Nos. 2,497,917 and 2,656,271, diaminophenazine and o-phenylenediamine described in *Journal of Japanese Photographic Association,* 11, 48 (1948), mercaptobenzimidazole, methylbenzothiazole, mercaptobenzoxazole, thiouracil, 5-methylbenzotriazole, compounds as described in Japanese Patent Publication 41,675/71, and the like. These are, of course, only a few examples and, in addition thereto, many compounds shown in patents or like literature can be used, e.g., those given in Kagaku Shashin Binran (Scientific Photographic Handbook), II, p. 119 (Maruzen, 1959).

Development inhibitors as described in Japanese Pat. Nos. 19,039/71, 6,149/70, U.S. Pat. No. 3,295,976, etc., can optionally be used in order to control surface layer development.

In addition, if desired, ammonium chloride, potassium chloride, sodium chloride, etc. can be added, controlling the concentration of chloride ion in the solution.

To the intensifier can be added, if desired, development accelerators, e.g., various pyridinium compounds or like cationic compounds represented by U.S. Pat. No. 2,648,604, Japanese Patent Publication No. 9,503/69 and U.S. Pat. No. 3,671,247, cationic dyes such as phenosafranine, neutral salts such as thallium nitrate or potassium nitrate, polyethylene glycol or derivatives thereof, polythioethers or like nonionic compounds as described in Japanese Patent Publication 9,504/69, U.S. Pat. Nos. 2,533,990, 2,531,832, 2,950,970 and 2,577,127, organic solvents as described in Japanese Patent Publication No. 9,509/69 and Belgium Pat. No. 682,862, organic amines, e.g., ethanolamine, ethylenediamine, diethanolamine, etc. In addition, accelerators as described in detail in L.F.A. Mason; *Photographic Processing Chemistry,* pp. 40–43 (Focal Press-London, 1966) can be used.

Further, benzyl alcohol as described in U.S. Pat. No. 2,515,147, phenylethyl alcohol, pyridine as described in *Journal or Japanese Photographic Association,* 14, 74 (1952), ammonia, hydrazine, amines and the like are also effective development accelerators.

Also, there can be added hydroxylamine sulfate, hydrochloride, sodium sulfite, potassium sulfite, potassium bisulfite, and sodium bisulfite as preservatives, if desired.

Furthermore, polyphosphoric acid compounds represented by sodium hexametaphosphate, sodium tetrapolyphosphate, sodium tripolyphosphate, potassium salts of these polyphosphoric acid, etc., and aminopolycarboxylic acids represented by ethylenediaminetetraacetic acid, nitriloacetic acid, cyclohexanediaminetetraacetic acid, iminodiacetic acid, N-hydroxymethylethylenediaminetriacetic acid, diethylenetriaminepentaacetic acid, etc. can be added as a water softener. The amount thereof to be used varies depending upon the hardness of water used, but they are usually used in an amount of about from about 0.5 to about 1 g/liter. Other calcium- and magnesium-masking agents can be used in the photographic processing solution. They are described in detail in J. Willems; *Belgisches Chemiches Industry,* 21, 325 (1956) and 23, 1105 (1958).

Organic solvents can be used according to the system, e.g., to raise the solubility of the developer components, particularly the developing agent.

Such organic solvents include ethylene glycol, hexylene glycol, diethylene glycol, methyl cellosolve, methanol, ethanol, acetone, triethylene glycol, dimethylformamide, dimethylsulfoxide, and compounds as described in Japanese Patent Publications Nos. 33,378/72 and 9,509/69. The amount thereof can be changed depending upon the components and composition of the solution, but usually not more than about 50 vol. %, mostly not more than 10 vol. %, based on the solution used, is added. However, as a solvent for the processing solution, they can be used in some cases for anhydrous systems.

The developing agent (or reducing agent) used in the present invention can be added to a processing solution and/or a light-sensitive material. In the case of being added to a processing solution, it is added to a developer and/or an intensifier. In the case of being added to a light-sensitive material, it is added to an emulsion layer together with a light-sensitive substance and/or in an adjacent layer, e.g., intermediate layer, protective layer, etc.

The most commonly used developing agents are primary aromatic amino compounds, i.e., p-phenylenediamine derivatives, though the present invention is not limited thereto. Typical examples thereof include N,N-diethyl-p-phenylenediamine hydrochloride, 2-amino-5-(N-ethyl-N-laurylamino)-toluene, 4-[Nethyl-N-(β-hydroxyethyl)amino]aniline sulfate, 2-methyl-4[N-ethylN-(β-hydroxyethyl)amino]aniline sulfate, N-ethyl-N-(β-methanesulfoamidoethyl-3-methyl-4-aminoaniline sesquisulfate monohydrate as described in U.s. Pat. No. 2,193,015,N-(2-amino-5-diethylaminophenylethyl)methyanesulfonamide sulfate as described in U.s. Pat. No. 2,592,364, N,N-diethyl-p-phenylenediamine hydrochloride, 4-amino3-methyl-N-ethyl-N-methoxyethylaniline as described in U.S. Pat. Nos. 3,656,950, 3,698,525, etc., 4-amino-3-methyl-N-ethyl-Nβ-ethoxyethylaniline and 4-amino-3-methoxy-N-ethyl-β-butoxyethylaniline, and the salts thereof (e.g., sulfates, hydrochlrides, sulfites, p-toluenesulfonates, etc.). In addition, there are those described in *Kagaku Shashin Binran* (Scientific Photographic Handbook), II, p. 2 (Maruzen, 1959) and L.F.A. Mason; *Photographic Processing* Chemistry (Focal Press-London, 1966), pp.226–229. The developing agents as described above are most preferably used in combination with couplers present in the image-forming material or in a processing solution. Examples of such couplers are described in *Mees & James; The Theory of Photographic Processes,* 3rd. ed., pp.387–392. Any conventional couplers can be used in the present invention, if desired.

In some cases, p-aminophenol derivatives can be used as the developing agent. In this case too, image formation is effected by adding the above-described couplers. Also, developing agents as described in British Pat. No. 1,221,935 can be used.

As the developing agent, there are also those which themselves form color images upon being oxidized or those which form a complex with a metal salt. As examples of such, there are the developing agents described in British Pat. No. 1,210,417, the tetrazolium salts described in U.S. Pat. No. 3,655,382, 2,4-diaminophenol, α-nitroso-β-naphthol, etc.

The developing agents also include various known tanning developing agents such as pyrogallol, catechol, 4-phenylpyrocatechol, chlorohydroquinone, etc. These have the function of image-wise hardening a gelatin film when oxidized with chlorite, chlorous acid, bromite or bromous acid.

In addition, all of the developing agents described in U.s. Pat. No. 3,674,490 can be used in the present invention.

The image-wise distributed catalytic muclei are generally the latent image formed in a silver salt light-sensitive material (see U.S. Pat. Nos. 3,765,891 and 3,846,130 for such processes), or a partly or completely reduced silver deposit (formed by developing the latent image nuclei; see U.S. Pat. Nos. 3,765,891 and 3,846,130 for such processes). In some cases, they may be nuclei of a noble metal formed by processing a latent image with a gold salt or platinum salt solution (see U.S. Pat. No. 3,512,972 for such processes). Also, in some cases, they may be a silver image transferred from a light-sensitive material to an image-receiving material (see Japanese Patent Application (OPI) 9,728/73 for such processes). They may also be nuclei intensified by processing a latent image formed on a photoconductive substance, such as titanium oxide or zinc oxide, with a noble metal compound such as silver salt or gold salt (see French Pat. No. 1,588,389 for such processes). Further, zero-valent metals or sulfides thereof selected from the metals of group Ib and VIII can be used as nuclei (see British Pat. No. 1,187,861 for such processes). Further, they may also be a metal which is substituted for the developed silver by, for instance, plating. Particularly effective catalysts are platinum, palladium, copper, gold, silver, copper sulfide and silver sulfide.

The developing agent is a compound which is oxidized by chlorite and/or chlorous acid, bromite and bromous acid or chlorine dioxide water in the presence of the catalytic material but, in areas where the catalytic material is absent, is oxidized only at a very low rate; the reducing agent can be an imageforming element by itself or can be one whose oxidized product reacts with a coupler to form images.

Ordinary photographing materials contain 3 - 10 $g/m^2$ (calculated as silver) of silver salt, and print materials contain about 1 - 4 $g/m^2$ of silver salt. In the present invention, the coated silver amount is not more than 5 $g/m^2$, preferably not more than 3 $g/m^2$. With multilayered emulsions, silver is used in an amount of not more than 2 $g/m^2$, preferably not more than 1$g/m^2$ and not less than 1 $mg/m^2$, per one layer.

In a typical example of the present invention wherein a coupler is added to a light-sensitive material, the amount of the coupler should be enough to provide a sufficient color density. Usually, couplers are present in an amount equivalent to or more than that of the silver present by weight (i.e., more than several times that of silver in molar ratio in any emulsion layer). As the coupler to be used, known ones can be optionally employed.

In one preferred embodiment of the invention, the photographic materials comprise a support having thereon at least one image dye-forming layer unit containing light-sensitive silver salt, preferably silver halide, having associated therewith a stoichiometric excess of coupler of at least 40 mole percent excess and preferably at least 70 mole percent excess. The coupler to silver ratio is based on effective silver as defined in U.S. Pat. No. 3,822,129, and is at least 1.4:1, preferably 1.7:1.

In the light-sensitive photographic emulsion layer of a color photographic light-sensitive material there is present a coupler, i.e., a compound capable of forming a dye by reaction with an oxidized developing agent. Such a coupler has a formula such that it does not diffuse into other layers during the production steps processing step thereof. Examples are given below.

As yellow couplers, open-chain diketomethylene compounds are widely used. Examples thereof are described in, for example, U.S. Pat. Nos. 3,341,331, 2,875,057, 3,551,155, German Patent OLS No. 1,547,868, U.S. Pat. Nos. 3,265,506, 3,582,322, 3,725,072, German Patent OLS Nos. 2,162,899, 3,369,895, 3,408,194, German Patent OLS Nos. 2,057,941, 2,213,461, 2,219,917, 2,261,361, 2,263,875, etc.

As megenta couplers, 5-pyrazolone compounds are mainly used, but indazolone compounds and cyanoacetyl compounds can also be used. Examples thereof are described in, for example U.S. Pat. Nos. 2,439,098, 2,600,788, 3,062,653, 3,558,319, British Pat. No. 956,261, U.S. Pat. Nos. 3,582,322, 3,615,506, 3,519,429, 3,311,476, 3,419,391, Japanese Patent Applications Nos. 21,454/73, 56,050/73, German Pat. No. 1,810,464, Japanese Patent Application No. 2,016/69, Japanese Patent Application No. 45,971/73 U.S. Pat. No. 2,983,608, etc.

As cyan couplers, phenol or naphthol derivatives are mainly used. Examples thereof are described in, for example, U.S. Pat. Nos. 2,369,929, 2,474,293, 2,698,794, 2,895,826, 3,311,476, 3,458,315, 3,560,212, 3,582,322, 3,591,383, 3,386,301, 2,434,272, 2,706,684, 3,034,892, 3,583,971, German Patent OLS No. 2,163,811, Japanese Patent Publication No. 28,836/70, Japanese Patent Application No. 33,238/73, etc.

In addition, couplers capable of releasing a development inhibitor upon color reaction (DIR couplers) or compounds capable of releasing a development inhibitor can also be added. Examples thereof are described in, e.g., U.s. Pat. Nos. 3,148,062, 3,227,554, 3,253,924, 3,617,291, 3,622,328, 3,705,201, British Pat. No. 1,201,110, U.S. Pat. Nos. 3,297,445, 3,379,529, 3,639,417, etc.

The above-described couplers and the like can be used in combinations of two or more in the same layer in order to satisfy various conventional requirements of light-sensitive materials, and it is, of course, possible to add the same compound to two or more different layers.

The color coupler incorporated in a unit layer of the present invention is a water-insoluble color coupler mixed with a coupler solvent (preferably a coupler solvent having a suitable polarity). The term "unit layer" as is used in the art means a blue sensitive silver halide emulsion layer, a green-sensitive silver halide emulsion layer or a red-sensitive silver halide emulsion layer, and is often used to include those situations where such basic silver halide emulsion layers are divided into two or more layers. As the coupler solvent, there is generally used a main solvent having a high boiling point (usually higher than 160° C, preferably 200° C, e.g., dibutyl phthalate or tricresyl phosphate, and an auxiliary solvent having a low boiling point (usually lower than 100° C, e.g., ethyl acetate, butyl acetate or cyclohexanone). Only the main solvent can be used if desired, and a mixture of two or more of such solvents can be also used.

As typical solvents, there are tri-o-cresyl phosphate, dibutyl phthalate, diethyllaurylamide, 2,4-diallylphenol, liquid dye stabilizers as described in *Product Licensing Index,* 83, pp. 26 - 29 (1971, March) and the like. A coupler solvent contained in an element also appears to accelerate absorbance of color developer between the color development bath and the intensifying bath.

It is convenient to select the photographic color couplers used so that middle scale images can be obtained. The maximum absorption band of a cyan dye formed preferably lies between about 600 and about 680 mm, the maximum absorption band of a magenta dye formed between about 500 mm and about 580 mm, and the maximum absorption band of a yellow dye formed between about 400 mm and about 480 mm in this invention.

The silver halide emulsion used is usually prepared by mixing an water-soluble silver salt (e.g,, silver nitrate) with a water-soluble halide (e.g., potassium bromide) in the presence of a water-soluble high molecular weight polymer solution such as a gelatin solution. As the silver halide, a mixed silver halide such as silver chlorobromide, silver bromoiodide, silver chlorobromoiodide, etc., can be used as well as silver chloride and silver bromide.

The silver halide grains may be in a cubic form, an octahedral from or a mixed crystal form thereof.

The silver halide grains are prepared according to conventional processes e.g., single- or double-jet process, a controlled double jet process, and the like.

It is also possible to mix two or more silver halide photographic emulsions which have been separately prepared. Further, as to the crystal structure of the silver halide grains, those which have a uniform structure, those wherein the interior and the exterior form different stratum structure, and those of the conversion type as described in British Pat. No. 635,841 and U.s. Pat. No. 3,622,318 may be used. Also, those which form latent image mainly on the grain surface and those of the internal latent image type which form a latent image inside the grains can be used. These photographic emulsions are also described in books such as Mees; *The Theory of Photographic Processes,* (MacMillan) P. Glafkides; *Chimie Photographique* (Paul Montel, 1957), and the like, and can be conventionally prepared according to an ammoniacal process, a neutral process, an acidic process and the like.

After the formation of such silver halide grains, water-soluble salt formed as a by-product (for example, potassium nitrate when silver bromide is prepared using silver nitrate and potassium bromide) is removed from the system by washing with water, and the system then heated in the presence of a chemical sensitizer such as sodium thiosulfate, N,N,N'-trimethylthiourea, thiocyanate complex salt of monovalent gold, thiosulfuric acid complex salt, stannous chloride, hexamethylenetetramine or the like to thereby enhance sensitivity without coarsening the grains. The general process therefor is described in the abovementioned books.

The above-described silver halide emulsion can be chemically sensitized in a conventional manner. As the chemical sensitizer, there are illustrated, for example, gold compounds such as a chloroaurate, auric chloride, etc., as shown in U.S. Pat. Nos. 2,399,083, 2,540,085, 2,597,856 and 2,597,915, salts of noble metals such as platinum, palladium, iridium, rhodium, ruthenium, etc., as shown in U.S. Pat. Nos. 2,399,083, 2,540,085, 2,597,856, 2,597,915, etc., sulfur compounds capable of forming silver sulfide by reaction with a silver salt as described in U.S. Pat. Nos. 1,574,944, 2,419,689, 3189,458, 3,501,313, etc., stannous salts as described in U.S. Pat. Nos. 2,487,850, 2,518,698, 2,521,925, 2,521,926, 2,694,637, 2,983,610, 3,201,254, etc., amines, and other reducing materials.

The photographic element preferably further contains various conventional additives in order to obtain desired development processing and image properties. In a particularly preferred embodiment where deposited silver functions as a catalyst, it is desirable to use additive which do not strongly adsorb on to the silver surfaces and therefore do not substantially reduce the effective surface area. Generally speaking, it is not desirable to use iodide salt or organic compounds having a free mercapto group and a high heat of absorption, such as phenylmercaptotetrazole, alkali metal iodide salts and the like in a large amount, as, they form silver salts more water-insoluble than silver bromide.

In general, it is desirable to add a silver halide antifogging agent to any light-sensitive layer of the photographic element. In several preferred embodiments, anti-fogging agents are used which do not strongly adsorb onto silver formed after development. Typical useful anti-fogging agents include hetero ring organic compounds such as tetrazoles, azaindenes, triazoles and the like.

The layer or layers of a photographic element used in the present invention may contain a hardener, a plasticizer, a lubricant, a surfacing agent, a glossing agent and other additives conventional in the photographic field, as long as they do not exert any detrimental influence on the element.

As the hydrophilic colloid to be used, there can be illustrated, e.g., gelatin, colloidal albumin, casein, cellulose derivatives (e.g., carboxymethyl cellulose, hydroxyethyl cellulose, etc.), sugar derivatives (e.g., agar-agar, sodium alginate, starch derivatives etc.), synthetic hydrophilic colloids (e.g., polyvinyl alcohol, poly-N-vinyl pyrrolidone, polyacrylic acid copolymer, polyacrylamide, derivatives or partially hydrolyzed products thereof, etc.). If desired, a compatible mixture of two of more of these colloids can be used. The most generally used colloid is gelatin. Gelatin can be replaced, partly or wholly, by a synthetic high molecular weight substance, by a gelatin derivative (prepared by processing and modifying gelatin with a reagent having a group capable of reacting with the functional groups contained in a gelatin molecule (i.e., amino groups, imino groups, hydroxy groups or carboxy groups) ), or by a graft polymer prepared by grafting a molecular chain of another high molecular weight substance onto gelatin. As the reagent for preparing the above-described gelatin derivatives, there are illustrated, e.g., isocyanates, acid chlorides and acid anhydrides as described in U.S. Pat. No. 2,614,928, acid anhydrides as described in U.S. Pat. No. 3,118,766, bromoacetic acid as described in Japanese Patent Publication No. 5,514/64, phenyl glycidyl ethers as described in Japanese Patent Publication No. 26,845,67, vinyl sulfone compounds as described in U.S. Pat. No. 3,132,945, N-allylvinylsulfonamides as described in British Pat. No. 861,414, maleinimide compounds as described in U.S. Pat. No. 3,186,846, acrylonitriles as described in U.S. Pat. No. 2,594,293, polyalkylene oxides as described in U.S. Pat. No. 3,312,553, epoxy compounds as described in Japanese Patent Publication No. 26,845/67, acid esters as described in U.S. Pat. No. 2,763,639, alkanesulfones as described in British Pat. No. 1,033,189, and the like.

As to high molecular weight polymers to be grafted onto gelatin, many examples are given in U.S. Pat. Nos. 2,763,625, 2,831,767, 2,956,884, *Polymer Letters,* 5, 595 (1967), *Phot. Sci. Eng.,* 9, 148 (1965), *J. Polymer Sci.,* A-1, 9, 3199 (1971), and the like. Homopolymers or copolymers of a vinyl monomers, such as acrylic acid, methacrylic acid, ester, amide, or nitrile derivatives thereof, styrene, etc., can be used. However, hydrophilic vinyl polymers having some compatibility with gelatin, such as homopolymers or copolymers of acrylic acid, acrylamide, methacrylamide, hydroxyalkyl acrylate, hydroxyalkyl methacrylate, etc. are particularly preferred.

The photographic emulsion can be subjected, if desired, to spectral sensitization or super-sensitization using cyanines, merocyanines, carbocyanines or like cyanine dyes alone or in combination or by further using styryl dyes or the like in combination. These color sensitizing arts have long been known and many are described, in e.g., U.S. Pat. Nos. 2,493,748, 2,519,001, 2,977,229, 3,480,434, 3,672,897, 3,703,377, 2,688,545, 2,912,329, 3,397,060, 3,615,635, 3,628,964, British Pat. Nos. 1,195,302, 1,242,588, 1,293,862, West German Patents OLS Nos. 2,030,326, 2,121,780, Japanese Patent Publications Nos. 4,936/68, 14,030/69, 17,773/68, U.S. Pat. Nos. 3,511,664, 3,522,052, 3,527,641, 3,615,613, 3,615,632, 3,617,295, 3,636,712, 3,694,217, British Pat. Nos. 1,137,580, 1,216,203, etc. The dyes can be selected according to the objects and end-use of the light-sensitive materials, such as the wavelength region to be sensitized and the sensitivity desired.

The photographic emulsion is coated on a planar substance which is dimensionally stable during processing, such as a hard support (like glass, metal procelain) or a flexible support. Typical flexible supports include a cellulose nitrate film, a cellulose acetate film, a cellulose acetate butyrate film, a cellulose acetate propionate film, a polystyrene film, a polyethylene terephthalate film, a polycarbonate film, laminates thereof, a thin glass film, paper, etc., conventionally used for photographic light-sensitive materials. Papers coated or laminated with baryta or an α-olefin polymer, in particular, polymers of an α-olefin having 2–10 carbon atoms such as polyethylene, polypropylene, ethylene-butene copolymers, etc., plastic films whose surface has been roughened to improve adhesion to other polymer substances and to raise printability as described in Japanese Patent Publication No. 19,068/72, and like supports, provide good results.

Transparent or opaque supports can be used, depending upon the end-use of the light-sensitive materials. With transparent supports, not only colorless transparent ones but transparent supports slightly colored by adding dyes or pigments can be used. Such have heretofore been used with X-ray films as is known (J. SMPTE, 67, p. 296 (1958), etc.

Opaque supports include inherently opaque ones like paper and, in addition, those prepared by adding dyes or pigments, e.g., titanium oxide, to a transparent film, a plastic film surface-treated according to the method described in Japanese Patent Publication No. 19,068/72, papers or plastic films to which carbon black, a dye or the like has been added to render the same completely light-intercepting, and the like. Where adhesion between the support and the photographic emulsion layer is insufficient, a subbing layer (layer having adhesion for both the support and the photographic emulsion layer) can be used. Also, in order to improve the adhesion, the surface of the support may be subjected to preliminary processings such as corona discharge, irradiation with ultraviolet rays, flame treatment, etc.

The above-specified photographic element of the present invention comprises a support having provided thereon a dye image-providing unit layer. Multi-color photographic elements contain at least two of the above-described dye image-providing unit layers, and respective layers record spectral light in different regions. A unit layer contains light-sensitive silver salt, which is generally spectrally sensitized in a specific region and is combined with a photographic color coupler. In order to prevent any color stain between dye image-providing unit layers, they are effectively separated from each other by a barrier layer, a spacer layer, a layer containing a scavenger for oxidized product of a developing agent, or the like. Methods for effectively separating unit layers from each other are known in this art and are conventionally used in commercial color products in order to prevent color stain. Also, a light-sensitive material having a development stain-preventing layer as described in U.S. Pat. No. 3,737,317, Japanese Patent Applications Nos. 73,445/73, 113,633/73, etc., can be used in the present invention.

The photographic element layer used in the present invention may be coated by various conventional coating processes including dip-coating, air knife-coating, curtain coating, and extrusion coating using a hopper as described in U.S. Pat. No. 2,681,294.

Two or more layers may be coated, if desired, at the same time according to the processes described in U.S. Pat. Nos. 2,761,791, 3,508,947, etc. The element may be designed so as to be used for a color image transfer process as described in U.S. Pat. Nos. 3,087,817, 3,185,567, 2,983,606, 3,253,915, 3,227,550, 3,227,551, 3,227,552, 3,145,633, 3,415,645 and 3,415,645, or for an absorption transfer process as descrbied in U.S. Pat. No. 2,882,156. In the case of using a dye-forming coupler or an oxidationreduction releasing type coupler in an element, at least two color-providing unit layers contain these couplers in an amount of at least 40% more than the stoichiometrical amount, based on the silver amount in the layers.

The developer used in the present invention contains one or more of the conventional developing agents (reducing agents) described above. The amount of the developing agent, is usually 0.1 to 50 g/l, preferably 1 to 30 g. If desired, an auxiliary developing agent such as a 1-phenyl-3-pyrazolidone can be used in combination therewith.

If desired, the developer compositions of the present invention can contain conventional additives as are commonly present in color developing baths. Common additives are those which have heretofore been set forth for addition to the intensifier bath, and all such additives can be used.

Further, the following compounds may be added, if desired, to the color developer.

For example, competitive couplers such as citrazinic acid, 2-amino-5-naphthol-7-sulfonic acid and 1-amino-8-naphthol3,6-disulfonic acid, those described in Japanese Pat. Publications Nos. 9,505/69, 9,506/69, 9,507/69, 14,036/70, 9,508/69, U.S. Pat. Nos. 2,742,832, 3,520,690, 3,560,212, 3,645,737, etc.

Fogging agents such as alkali metal borohydrides, amineborane and ethylenediamine, can be added, e.g., those described in Japanese Patent Publication No. 38,816/72.

As auxiliary developing agents, those such as p-aminophenol, benzyl-p-aminophenol and 1-phenyl-3-pyrazolidone, can be added, e.g., those in Japanese Patent Publications Nos. 41,475/70, 19,037,/71, 19,438/71, etc. The amount of the auxiliary developing agent(s) added is preferably 0.01 – 1.0 g/liter.

A typical example of a color developer comprising the above-described various components is shown in *Kagaku Shashin Brinran* (Scientific Photographic Handbook), p.72 (Maruzen, 1959).

In a typical process of the present invention, a color light-sensitive material containing catalyst nuclei is intensified, after development, with chlorite, chlorous acid and/or chlorine dioxide, bromite and bromous acid, water, fixed, washed and dried to provide images of high density.

In another process of the present invention, a color light-sensitive material containing catalyst nuclei is intensified, after development, with an intensifier, bleached and fixed or bleach-fixed, washed and dried to provide color images, for example, as taught in U.S. Pat. No. 3,582,322.

It is also possible to wash, after intensification, with water and again bleach.

Also, in a further process of the invention, a developing agent as earlier described is added to an emulsion layer or an adjacent layer, e.g., intermediate layer, protective layer, etc., and the light-sensitive material is processed with an aqueous solution containing chlorite, chlorous acid and/or chlorine dioxide water, bromite and bromous acid without processing with a developer, to conduct development and intensification at the same time, and bleached and fixed or bleach-fixed, washed and dried to provide color images. The proportion of developing agent in this embodiment is preferably about 1 to 30 g, most preferably 3 to 20 g, per mol of silver halide.

In a still further process, a so-called combined development-intensifying and fixing is conducted by processing a light-sensitive material containing a developing agent in an emulsion layer or an adjacent layer thereof with an intensifier containing a fixing agent, which is followed by rinsing and drying. As a modification, a combined developing and intensifying and stabilizing processing (see U.S. Pat. Nos. 2,515,121, 2,518,686, 3,140,177 and 3,582,322 for useful stabilizers), can be conducted which does not require washing and rinsing.

In yet a further process, it is possible to intensify, after development, and fix without bleaching, followed by washing and drying. This process is suitable for X-ray light-sensitive materials.

In the case of using light-sensitive materials containing a particularly low amount of silver, it is possible to intensify, after development, then wash and dry.

In a still further process, a coupler can be added to the developer. As coupler added to the developer (termed a coupler-in-developer system), there are illustrated those described in, e.g., U.S. Pat. Nos. 3,002,836 and 3,542,552 as cyan couplers, those described in, e.g., Japanese Patent Publication No. 13,111/69 as magenta couplers and those described in, e.g., U.S. Pat. No. 3,510,306 as yellow couplers. In this case, the couplers are used in a concentration of 0.5 - 5 g/liter, particularly 1 - 2.5 g/liter.

In a still further process, development is conducted by superposing a light-sensitive layer and an image-receiving layer (one over the other) and interposing a developer therebetween (see U.S. Pat. No. 2,673,800 and German Patent No. 1,095,115 for useful developers and image receiving layers), and dyes, which have been rendered diffusible by the oxidation with chlorite, chlorous acid, chlorine dioxide water, bromite and/or bromous acid, diffuse into the image-receiving layer. Conversely, it is also possible to transfer diffusible dyes from the areas which have not undergone oxidation.

In another embodiment of the present invention, a gelatino silver salt- light-sensitive material is developed, after exposure, with a tanning developer (useful tanning developers are disclosed in U.S. Pat. No. 3,293,035 and British Pat. No. 920,310). Upon tanning development, cross-linking of gelatin occurs at exposed areas due to the chlorite, chlorous acid, chlorine dioxide water, bromite and/or bromous acid, that is, tanning is strengthened. Then, the light-sensitive material is washed-off (after or without fixing) with warm water to form a relief image.

In a color system, subtractive type dye images can be formed according to the color negative process as described in T. Hanson and W.I. Kesner; *Journal of the Society of Motion Picture and Television Engineers,* vol.61 (1953), pp.667 - 701, or by using a direct positive emulsion (see U.S. Pat. Nos. 3,630,731 and 3,635,707 for typical direct positive emulsions), or by a color reversal process using a negative which forms a negative silver image when image-wise exposed and developed in a black-and-white developer, exposed at least one more time (or subjected to some other suitable fogging procedure), and subsequently subjected to color development to yield a subtractive colored dye image as disclosed in, for example, C.E.K. Mees; *The Theory of the Photographic Process* 3rd. edition, pp.1051 - 1056 (1693) and L.F.A. Mason; *Photographic Processing Chemistry* pp.251 - 260 (1966). In this case, in order to prevent silver deposits formed in the first development from acting as a catalyst in the second development, a bleaching step is provided after the black-and-white development and an intensifying step is generally conducted after color development.

The processing of the present invention can be effected at any temperature, but is usually conducted at temperatures not lower than about 10° C and not higher than about 70° C, particularly not lower than 20° C and not higher than 60° C.

The present process is superior to conventional processes at the following points.

Firstly, since only metal catalyst nuclei, e.g., silver, function as a catalyst for the oxidation-reduction reaction, a slight amount thereof is enough to achieve the desired results. Therefore, the amount of silver or like metal or the amount of metal salt can be markedly reduced.

Secondly, chlorous acid, chlorite, chlorine dioxide water, bromous acid and/or bromite is stable in aqueous solutions, and provides an image-intensifying solution of excellent stability.

Thirdly, as compared with conventional cobalt complex salts, image intensification with a markedly higher intensifying effect can be conducted.

Fourthly, as compared with conventional peroxides, the disadvantageous phenomenon of color image destruction does not occur.

Fifthly, as compared with conventional peroxides, fog due to intensification is remarkably low.

These merits show the great excellence of the image-intensifying processing of the present invention.

The present invention will now be illustrated in more detail by the following examples which, however, do not limit present invention in any way.

All processings were conducted at room temperature and atmospheric pressure, and that all parts, percentages and ratios were by weight, unless otherwise indicated?

Where pH adjustment was necessary it was effected by using sodium hydroxide or sulfuric acid in all examples.

EXAMPLE 1

A photographic element comprising a cellulose acetate support having provided thereon 120 mg Ag/m$^2$ of a silver bromochloride emulsion (silver chloride content: 55 mol%) and 2.8 $\times$ 10$^{-3}$ mol/m$^2$ of a coupler dispersion prepared by dissolving 2[α-2,4-di-t-amylphenoxy)-butyramido]-4,6-dichloro-5-methylphenol (cyan coupler) in di-n-butyl phthalate (coupler solvent) and dispersing the solution in a gelatin solution to form an o/w type emulsion using sorbitan monolaurate, Turkey red oil and sodium dodecylbenzenesulfonate (as emulsifying and dispersing agents), was prepared. This photographic element was exposed using a sensitometer (tungsten lamp (4800° K; 25 CMS (1/50 second); same conditions in Examples 6, 11 and 16) ) and subjected to the following processings.

| | | | |
|---|---|---|---|
| Processing Steps: | | | |
| Development | 25° C | 1 min | |
| Intensification | " | 3 min | or 6 min |
| Bleach-fixing | " | 3 min | |
| Washing | " | 2 min | |
| Stabilizing | " | 1 min | |
| Composition of each processing bath | | | |
| Developer | | | |
| Benzyl alchol | 10 ml | | |
| Sodium Sulfite | 2 g | | |
| Potassium Bromide | 0.5 g | | |
| Sodium Carbonate (monohydrate) | 30 g | | |
| 4-Amino-3-methyl-N-ethyl-N-(β-hydroxyethyl)aniline Sulfate | 5 g | | |
| Water to make | 1 liter | | |

Intensifiers A - D*

| Intensifier | Composition (per 1 liter) | | | |
|---|---|---|---|---|
| A | Sodium Carbonate (monohydrate) | 10 g | | |
| B | " | " | Hexamminecobalt Chloride | 20 g |
| C | " | " | Hydrogen Peroxide Water (33%) | 60 ml |
| D | " | " | Sodium Chlorite | 20 g |

| | |
|---|---|
| Bleach-fixing Solution | |
| Ammonium Ihiosulfate (70%) | 150 ml |
| Sodium Sulfite | 5 g |
| Na[Fe(EDTA)] | 40 g |
| EDTA | 4 g |
| Water to make | 1 liter |
| Stabilizing Solution | |
| Glacial Acetic Acid | 10 ml |
| Sodium Acetate 5 | g |
| Formalin (37%) | 5 ml |
| Water to make | 1 liter |

*pH = 10.3

The photographic properties of the resulting element are shown in following Table 1.

Table 1

| Intensifying Time | 3 min | | 6 min | |
|---|---|---|---|---|
| Photographic Property Intensifier | Fog | Maximum Density | Fog | Maximum Density |
| A | 0.05 | 1.50 | 0.06 | 1.56 |
| B | 0.06 | 1.80 | 0.07 | 1.87 |
| C | 0.21 | 2.64 | 0.24 | 2.10 |
| D | 0.07 | 2.32 | 0.08 | 2.62 |

As is shown in Table 1, the conventional intensification using hydrogen peroxide caused high fog and, when the intensifying time was 6 minutes, caused destruction of color images and a reduction in maximum density. With the intensification using the cobalt complex salt, the intensification degree was less than that with hydrogen peroxide and sodium chlorite in accordance with the present invention. With sodium chlorite in accordance with the present invention, such defects were not observed and an excellent intensifying effect was shown.

EXAMPLE 2

Intensifiers B – D of Example 1 were stored at room temperature and analyzed after 1, 2, 3 and 7 days to examine the residual ratio* of $[Co(NH_3)_6]Cl_3$, $H_2O_2$, and $NaClO_2$, with the results being shown in Table 2.

* residual ratio indicates weight of intensifying agent in stored (days elapsed) solution/weight of intensifying agent in fresh solution; hereafter this term has the same meaning.

Table 2

| No. | Intensifying Agent | Days Elapsed 1 day | 2 days | 3 days | 7 days |
|---|---|---|---|---|---|
| B | $[Co(NH_3)_6]Cl_3$ | 0.98 | 0.95 | 0.90 | 0.80 |
| C | $H_2O_2$ | 0.25 | 0.15 | 0.03 | 0 |
| D | $NaClO_2$ | 1.00 | 1.00 | 0.99 | 0.97 |

As is shown in Table 2, hydrogen peroxide underwent a rapid decomposition with the passage of time. Sodium chlorite underwent extremely small decomposition. The cobalt complex was less stable than $NaCl_2O$.

EXAMPLE 3

A photographic element comprising a polyethylene coated paper support having provided thereon 100 mg $Ag/m^2$ of a silver chlorobromide emulsion (silver chloride content: 70 mol %) and $4.0 \times 10^{-3}$ $mol/m^2$ of a coupler dispersion prepared by dissolving 1-(2,4,6-trichlorophenyl)-3-{5[α-(3-tert-butyl-4-hydroxyphenoxy)-tetradecanamido]-2-chloroanilino}-5-pyrazolone (magenta coupler) in tricresyl phosphate (coupler solvent) and dispersing the solution in a gelatin solution to form an o/w type emulsion using sorbitan monolaurate, Turkey red oil and sodium dodecyl benzenesulfonate (as emulsifying and dispersing agents), was prepared. This photographic element was exposed using a sensitometer (tungsten lamp (2854°K;500 CMS; 1 second); same conditions in Examples 4, 5, 8–10 and 13–15) and subjected to the following processings.

| | | |
|---|---|---|
| Processing Steps: | | |
| Development | 31° C | 1 min |
| Intensification | " | 1 min |
| Bleach-fixing | " | 2 min |
| Washing | " | 1 min |
| Stabilizing | " | 30 sec |
| Composition of each processing solution: | | |
| Developer | | |
| Sodium Tetrapolyphosphate | | 2.0 g |
| Benzyl Alcohol | | 15 ml |
| Sodium Sulfite | | 2 g |
| Hydroxylamine Sulfate | | 2 g |
| Potassium Bromide | | 0.5 g |
| 4-Amino-N-ethyl-N-(β-methanesulfonamidoethyl)-m-toluidine sesquisulfate monohydrate | | 10 g |
| Water to make | | 1 liter |

Intensifier

-continued

| Intensifier | Composition $NaClO_2$ g/l | $Na_2CO_3 \cdot (H_2O)$ g/l | ph |
|---|---|---|---|
| E | 0 | 10 | 11.0 |
| F | 10 | " | " |
| G | 20 | " | " |
| H | 40 | " | " |
| I | 80 | " | " |
| J | 160 | " | " |
| K | 320 | " | " |
| Bleach-fixing Solution | | | |
| Stabilizing Solution | Same as in Example 1 | | |

The photographic properties of the thus photographic elements are shown in Table 3.

Table 3

| Intensifier | Photographic Property Fog | Max. Density |
|---|---|---|
| E | 0.06 | 1.30 |
| F | 0.07 | 1.55 |
| G | 0.07 | 1.64 |
| H | 0.08 | 1.76 |
| I | 0.08 | 1.92 |
| J | 0.09 | 2.27 |
| K | 0.09 | 2.51 |

From Table 3, it is seen that maximum density markedly increased as the amount of sodium chlorite increased. Also, the results show that the intensifying process of the present invention provided excellent effects.

EXAMPLE 4

A photographic element comprising a polyethylene coated paper support having provided thereon 100 mg $Ag/m^2$ of a silver chlorobromide emulsion (silver chloride content: 70 mol %) and $3 \times 10^{-3}$ $mol/m^2$ of a coupler despersion prepared dissolving α-pivalyl-2-chloro-4-(4-benzyloxyphenylsulfomyl)-phenoxy-5-[α-(2,4-di-tert-amylphenoxy) butanamide]-acetanilide (yellow coupler) in di-n-butyl phthalate (coupler solvent) and emulsifying the solution in a gelatin solution to form an o/w emulsion using sorbitan monolaurate, "Turkey red oil" and sodium dodecylbenzenesulfonate (as emulsifying and dispersing agents), was prepared. This photographic element was subjected to the same processing as in Example 3, except that as the intensifiers, those of the following compositions were used.

| Intensifier | Composition $NaClO_2$ g/l | $Na_2CO_3(H_2O)$ | pH |
|---|---|---|---|
| L | 0 | 10 | 9.0 |
| M | 0 | " | 11.0 |
| N | 40 | " | 9.0 |
| O | " | " | 10.0 |
| P | " | " | 11.0 |
| Q | " | " | 12.0 |
| R | " | " | 12.5 |

pH adjustment was effected using sodium hydroxide or sulfuric acid. The results obtained are shown in Table 4.

Table 4

| Intensifier | Photographic Property Fog | Maximum Density |
|---|---|---|
| L | 0.05 | 1.41 |
| M | 0.06 | 1.48 |
| N | 0.06 | 1.80 |

Table 4-continued

| Intensifier | Photographic Property Fog | Maximum Density |
|---|---|---|
| O | 0.06 | 1.91 |
| P | 0.07 | 1.94 |
| Q | 0.08 | 2.08 |
| R | 0.09 | 2.15 |

Table 4 shows that maximum density increased as the pH of the intensifier increased; the increase in fog was extremely small.

EXAMPLE 5

A silver bromide emulsion containing a yellow coupler emulsion dispersion, a silver bromochloride emulsion (silver chloride content: 70 mol %) containing a magenta coupler emulsion dispersion, a silver chlorobromide emulsion (silver chloride content: 70 mol %) containing a cyan coupler emulsion dispersion, and a gelatin layer containing an ultraviolet ray-absorbing agent were coated on a baryta paper to prepare a color paper.

Each coupler emulsion was prepared by dissolving the coupler in a mixture of dibutyl phthalate and tricresyl phosphate and dispersing the same in a gelatin solution to form an o/w emulsion using sorbitan monolaurate, Turkey red oil and sodium dodecylbenzenesulfonate as emulsifying agents.

As the couplers, 1-(2',4',6'-trichlorophenyl)-3-[3'-(2'',4''-di-tert-amylphenoxyacetamido)benzamido]-5-pyrazolone, 1-hydroxy-4-chloro-2-n-dodecylnaphthamide and α-(2-methylbenzoyl)-aceto-(2'-chloro-5'-dodecoxycarbonyl)anilide were used. Also, as an ultraviolet ray-absorbing agent, compound 1 of Japanese Patent Publication No. 9,586/70 was used. 2,4-dichloro-6-hydroxy-1,3,5-triazine sodium salt was used in the emulsion as a hardening agent.

The coated amounts of the couplers and silver halide in the color paper were as follows:

| | Amount of Coupler Coated ($g/m^2$) | Amount of Silver Halide Coated ($g/Ag/m^2$) |
|---|---|---|
| Red-sensitive Layer | 0.4 $g/m^2$ | 0.02 |
| Green-sensitive Layer | 0.5 $g/m^2$ | 0.02 |
| Blue-sensitive Layer | 0.4 $g/m^2$ | 0.02 |

The photographic element was exposed using a sensitometer and subjected to the following processings.

| | | |
|---|---|---|
| Processing Steps: | | |
| Development | 31° C | 2 min |
| Intensification | " | 2 min |
| Bleach-fixing | " | 2 min |
| Washing | " | 2 min |
| Stabilizing | " | 30 sec |
| Composition of each processing solution: | | |
| Developer | | |
| Sodium Sulfite | | 2.5 g |
| Potassium Bromide | | 0.5 g |
| 2-Amino-5-diethylamino-toluene Hydrochloride | | 2.5 g |
| Sodium Carbonate Monhydrate | | 30 g |
| Sodium Hydroxide | | 0.5 g |
| Water to make | | 1 liter |

| Intensifier | Intensifier S | Intensifier T |
|---|---|---|
| Sodium Chlorite | 0 g | 80 g |
| Sodium Carbonate | 10 g | 10 g |
| Benzyl Alcohol | 10 ml | 10 ml |

-continued

| | |
|---|---|
| (Water added to make 1 liter: pH was adjusted to 11.0). | |
| Bleach-fixing Solution | |
| Stabilizing Solution | Same as in Example 1. |

The results obtained are shown in the Table 5.

Table 5

| Intensifier | Maximum Density Red | Green | Blue |
|---|---|---|---|
| S | 0.9 | 1.1 | 1.2 |
| T | 2.4 | 2.3 | 2.0 |

Intensifier T in accordance with the present invention markedly increased color density.

EXAMPLE 6

A color negative type monolayer film comprising a cellulose acetate support having provided thereon 500 mg Ag/m² of a silver bromoiodide emulsion (silver iodide content: 6 mol %) and $4.1 \times 10^{-3}$ mol/m² of a coupler dispersion prepared by emulsifying and dispersing 1-hydroxy-4-chloro-2-n-dodecylnaphthamide (cyan coupler) as an o/w emulsion, was prepared; the coupler was dissolved in tricresyl phosphate and then dispersed in an aqueous gelatin solution. After exposure using a sensitometer, the element was subjected to the following processings.

| | | |
|---|---|---|
| Processing Steps: | | |
| Color Development | 38° C | 2 min |
| Intensification | " | 2 min |
| Bleaching | " | 6 min and 30 sec |
| Washing | " | 3 min and 15 sec |
| Fixing | " | 6 min and 30 sec |
| Washing | " | 3 min and 15 sec |
| Stabilizing | " | 1 min and 30 sec |
| Drying | | |
| Composition of each processing solution: | | |
| Color Developer | | |
| Sodium Tetrapolyphosphate | | 2.0 g |
| Sodium Sulfite | | 2.0 g |
| Sodium Carbonate (monohydrate) | | 30 g |
| Potassium Bromide | | 2.0 g |
| Hydroxylamine Sulfate | | 3.0 g |
| 3-Methyl-4-amino-N-ethyl-N-β-hydroxyethylaniline Sulfate | | 5.0 g |
| Water to make | | 1 liter |
| Intensifier | | |
| Sodium Carbonate | | 10 g |
| Sodium Chlorite | | 40 g |
| Water to make (pH: adjusted to 11.0) | | 1 liter |
| Bleaching Solution | | |
| Ammonium Bromide | | 150 g |
| Aqueous Ammonia (28 wt%) | | 5 ml |
| Iron(III)-Sodium Ethylenediamine-tetraacetate | | 100 g |
| Water to make | | 1 liter |
| Fixing Solution | | |
| Sodium Tetrapolyphosphate | | 2.0 g |
| Sodium Sulfite 15 | | g |
| Ammonium Thiosulfate (70% Solution) | | 150 ml |
| Water to make | | 1 liter |
| Stabilizing Solution | | |
| Formaldehyde (37% Solution) | | 5.0 ml |
| Water to make | | 1 liter |

As a result of the above processing, there was obtained a good cyan image having high maximum density and low fog.

EXAMPLE 7

A light-sensitive material comprising a polyethylene terephthalate support having provided thereon 1 g Ag/m² of a high speed silver bromoiodide gelatin emulsion (silver iodide: 1 mol %) and $8 \times 10^{-3}$ mol/m² of 5-[α-(2,4-di-teert-amylphenoxy)-hexamido]-2-heptafluorobutylamidophenol(cyan coupler) -di-tert-amylphenoxy)-hexamido]dispersion was prepared; the coupler was dissolved in tricresyl phosphate and then dispersed in an aqueous gelatin solution. This light-sensitive material was sandwiched between two sheets of fluorescent intensifying foil having a calcium tungstate-containing layer, and X-ray exposure was conducted through an aluminum step wedge. The material was then subjected to the following processings.

| | | |
|---|---|---|
| Processing Steps: | | |
| Color Development | 35° C | 30 sec |
| Intensification | " | 1 min and 30 sec |
| Washing | " | 15 sec |
| Fixing | " | 30 sec |
| Washing | " | 45 sec |
| Composition of each processing solution: | | |
| Color Developer | | |
| Sodium Hexametaphosphate | | 1 g |
| Sodium Sulfite | | 2 g |
| 1-Phenyl-3-pyrazolidone | | 0.5 g |
| Potassium Bromide | | 1 g |
| Sodium Carbonate (monohydrate) | | 50 g |
| Hydroxylamine Sulfate | | 2 g |
| N,N-Diethyl-p-phenylenediamine Hydrochloride | | 6 g |
| Water to make | | 1 liter |
| Intensifier | | |
| Sodium Carbonate Monohydrate | | 20 g |
| Sodium Chlorite | | 100 g |
| Water to make | | 1 liter |
| (pH adjusted to 11.5 with sodium hydroxide) | | |
| Fixing Solution | | |
| Same as that of Example 6. | | |

As a result of the above processing, there was obtained a good image (cyan color image plus silver image) having high maximum density and low fog.

EXAMPLE 8

A photographic element comprising the following elements (1) - (7) was prepared:

1. Polyethylene coated paper support.
2. A layer of a blue-sensitive silver chlorobromide emulsion (silver chloride content: 20 mol %) containing 150 mg/m² of silver, 1,500 mg/m² of gelatin and 600 mg/m² of the yellow coupler, α-pivalyl-α-[2,4-dioxo-5,5'-dimethyloxazolidin-3-yl]-2-chloro-5-[α-(2,4-di-t-amylphenoxy)butanamido]acetanilide, dissolved in 300 mg/m² of dioctylbutyl phosphate.
3. A layer containing 1,000 mg/m² of gelatin.
4. A layer of a green-sensitive silver chlorobromide emulsion (silver chloride content: 70 mol %) containing 100 mg/m² of silver, 800 mg/m² of gelatin, and 350 mg/m² of the magenta coupler, 1-2,4,6-trichlorophenyl)-3-[2-chloro-5-tetradecanamido]anilino-2-pyrazolin-5-one, dissolved in 170 mg/m² of tricresyl phosphate.
5. A layer containing 1,000 mg/m² of gelatin, an ultraviolet ray-absorbing agent as in Example 5 and 50 mg/m² of dioctylhydroquinone.
6. A layer of a red-sensitive silver halide emulsion (silver chloride content: 70 mol %) containing 100 mg/m² of silver, 700 mg/m² of gelatin and 300 mg/m² of the cyan coupler -[α-(2,4-di-t-amylphenoxy)-butanamido]-4,6-dichloro-5-methylphenol, dispersed in 150 mg/m² of n-butyl phthalate.
7. A layer containing 1,000 mg/m² of gelatin.

This photographic element was exposed using a sensitomer and subjected to the following processings.

| Processing Steps: | | |
|---|---|---|
| Color Development | 40° C | 1 min |
| Intensification | " | 1 min and 30 sec |
| Washing | 26° C | 30 sec |
| Bleach-fixing | 40° C | 1 min |
| Washing | 26° C | 1 min and 30 sec |
| Drying | | |

| Composition of each processing solution: | |
|---|---|
| color Developer | |
| Benzyl Alcohol | 15 ml |
| Potassium Carbonate | 30 g |
| Potassium Bromide | 0.4 g |
| Hydroxylamine Sulfate | 2 g |
| Potassium Sulfite | 4 g |
| Diaminopropanoltetraacetic Acid | 3 g |
| N-Ethyl-N-methoxyethyl-3-methyl-p-phenylenediamine di-p-toluenesulfonate | 7.5 g |
| Water to make | 1 liter |
| Intensifer | |
| Benzyl Alcohol | 15 ml |
| Potassium Carbonate | 7.5 g |
| Sodium chlorite | 40 g |
| Water to make | 1 liter (pH: 10.0) |
| Beach-fixing Solution | |
| Same as used in Example 1. | |

For purposes of comparison, identical processings were conducted except for using a sodium chlorite-free intensifier.

The photographic properties obtained are shown in Table 6.

Table 6

| Intensifier | Maximum Density Red | Green | Blue |
|---|---|---|---|
| U (present invention) | 2.48 | 2.27 | 2.32 |
| V (comparison) | 1.10 | 1.08 | 1.60 |

The sodium chlorite-containing intensifier of the present invention markedly increased color density.

EXAMPLE 9

A photographic emulsion comprising a polyethylene coated paper support having provided thereon 100 mg/m² of a silver chlorobromide emulsion (silver chloride content: 70 mol %) and 700 mg/m² of a coupler dispersion prepared by dissolving 1-(2,4,6-trichlorophenyl)-3-[2-chloro-5-tetradecanamido]anilino-2-pyrazoline-5-one in tricresyl phosphate and emulsifying and dispersing the solution in a gelatin solution to form an o/w emulsion using sorbitan monolaurate, Turkey red oil and sodium dodecylbenzenesulfonate as emulsifying and dispersing agents was prepared. The element was then exposed using a sensitometer and subjected to the following processings.

| Processing Steps: | |
|---|---|
| Same as in Example 8. | |
| Composition of each processing solution: | |
| Color Developer | |
| Benzyl Alcohol | 15 ml |
| Potassium Carbonate | 30 g |
| Potassium Bromide | 0.5 g |
| Hydroxylamine Sulfate | 3 g |
| Sodium Sulfite | 3 g |
| Diethylenetriaminepentaacetic Acid | 4 g |
| 4-Amino-N-ethyl-N[β-methanesulfonamidoethyl]-m-toluidine Sesquisulfate Monohydrate | 8 g |
| Water to make | 1 liter (pH: 10.1) |
| Intensifier | |
| Benzyl Alcohol | 5 ml |
| Potassium Carbonate | 10 g |
| Sodium Chlorite (25% Solution) | 150 ml |
| Diethylenetriaminepentaacetic Acid | 10 g |
| 5-Nitrobenzimidazole Nitrate | 200 mg |
| Water to make | 1 liter (pH: 10.1) |
| Bleach-fixing Solution | |
| Same as in Example 1. | |

As a result of the above-processing, there was obtained a good image having high maximum density (DG = 2.23) and low fog. On the other hand, when identical processing was conducted but for using an intensifier free of sodium chlorite, there were obtained images of low maximum density (DG = 0.91).

EXAMPLE 10

A photographic element comprising a polyethylene coated paper support having provided thereon 100 mg/m² of a silver chlorobromide emulsion (silver chloride content: 20mol %) and 800 mg/m² of a coupler dispersion prepared by dissolving α-pivaloyl-α-(2,4-dioxo-5,5'-dimethylhydantoin-3-yl)-2-chloro-5-[α-(2,4-di-t-amylphenoxy)butanamido]acetanilide in di-n-butyl phthalate and ethyl acetate and dispersing the solution, was prepared. The photographic element was exposed using a sensitometer and subjected to the same processings as in Example 8.

For comparison purpose, identical processings were conducted except for using a sodium chlorite-free intensifier and an intensifier prepared by adding 10 g of $[Co(NH_3)_6]Cl_3$ in place of the sodium chlorite as in Example 8.

The photographic properties obtained are shown in Table 7.

Table 7

| No. | Intensifying Agent | Fog | Relative Sensitivity* | Maximum Density |
|---|---|---|---|---|
| W | $NaClO_2$ | 0.12 | 1.65 | 2.36 |
| X | none | 0.11 | 1.00 | 1.03 |
| Y | $[Co(NH_3)_6]Cl_3$ | 0.45 | 1.42 | 2.15 |

(Relative sensitivity is a relative value of the logarithmic sensitivity taking the sensitivity of X as 100.)

As is shown in Table 7, intensifier (W) of the present invention [using sodium chlorite] provided an image of high sensitivity and high maximum density with low fog. On the other hand, comparative intensifier (Y) using $[Co(NH_3)_6]Cl_3$ caused serious fog. Intensifier (X) provided less fog, but did not provide sufficient sensitivity and maximum density.

EXAMPLE 11

A photographic element comprising cellulose acetate support having provided thereon 120 mg Ag/m² of a silver bromochloride emulsion (silver chloride content: 55 mol %) and $2.8 \times 10^{-3}$ mol/m² of a coupler dispersion prepared by dissolving 2-[α-2,4-di-t-amylphenoxy)-butyramido]-4,6-dichloro-5-methylphenol (cyan coupler) in di-n-butyl phthalate (coupler solvent) and dispersing the solution in a gelatin solution to form an o/w type emulsion using sorbitan monolaurate, Turkey red oil and sodium dodecylbenzenesulfonate (as emulsifying and dispersing agents), was prepared. The photographic element was exposed using a sensitomer and subjected to the following processings.

| | | |
|---|---|---|
| Processing Steps: | | |
| Development | 25° C | 1 min |
| Intensification | " | 3 min or 6 min |
| Bleach-fixing | " | 3 min |
| Washing | " | 2 min |
| Stabilizing | " | 1 min |
| Composition of each processing bath: | | |
| Developer | | |
| Benzyl Alcohol | | 10 ml |
| Sodium Sulfite | | 2 g |
| Potassium Bromide | | 0.5 g |
| Sodium Carbonate (monohydrate) | | 30 g |
| 4-amino-3-methyl-N-ethyl-N-(β-hydroxyethyl)aniline Sulfate | | 5 g |
| Water to make | | 1 liter |

Intensifiers a - d*

| Intensifier | Composition (per 1 liter) | | | |
|---|---|---|---|---|
| a | Sodium Carbonate (monohydrate) | 10 g | | |
| b | " | " | Hexamminecobalt Chloride | |
| c | Sodium Carbonate (monohydrate) | 10 g | Hydrogen Peroxide Water (33%) | 60 ml |
| d | " | " | Sodium Bromite | 20 g |

*pH = 10.3

| | |
|---|---|
| Bleach-fixing Solution | |
| Ammonium Thiosulfate (70%) | 150 ml |
| Sodium sulfite | 5 g |
| Na[Fe(EDTA)] | 40 g |
| EDTA | 4 g |
| Water to make | 1 liter |
| Stabilizing Solution | |
| Glacial Acetic Acid | 10 ml |
| Sodium Acetate | 5 g |
| Formalin (37%) | 5 ml |
| Water to make | 1 liter |

The photographic properties obtained are shown in Table 8.

Table 8

| Intensifying Time / Photographic Property | 3 minutes | | 6 minutes | |
|---|---|---|---|---|
| Intensifier | Fog | Maximum Density | Fog | Maximum Density |
| a | 0.05 | 1.50 | 0.06 | 1.56 |
| b | 0.06 | 1.80 | 0.07 | 1.87 |
| c | 0.21 | 2.64 | 0.24 | 2.10 |
| d | 0.09 | 2.24 | 0.10 | 2.54 |

As is shown in Table 8, the conventional intensification using hydrogen peroxide caused high fog and, when the intensifying time was 6 minutes, caused destruction of color images and a reduction in maximum density. With the intensification using the cobalt complex salt, the intensification degree was less than that with hydrogen peroxide and sodium bromite in accordance with the present invention. With sodium bromite of the present invention, such defects were not observed and an excellent intensifying effect was achieved.

EXAMPLE 12

Intensifiers a - d used in Example 11 were stored at room temperature and analyzed after 1, 2, 3 and 7 days to examine the residual ratio of $[Co(NH_3)_6]Cl_3$, $H_2O_2$ and NaBrO. The results are shown in Table 9.

Table 9

| Intensifier | | Days Elapsed | | | |
|---|---|---|---|---|---|
| No. | Intensifying Agent | 1 day | 2 days | 3 days | 7 days |
| b | $[Co(NH_3)_6]Cl_3$ | 0.98 | 0.95 | 0.90 | 0.80 |
| c | $H_2O_2$ | 0.25 | 0.15 | 0.03 | 0 |
| d | $NaBrO_2$ | 1.00 | 1.00 | 0.98 | 0.97 |

As is shown in Table 9, hydrogen peroxide underwent rapid decomposition with time. Sodium bromite underwent an extremely small decomposition.

EXAMPLE 13

A photographic element comprising a polythylene coated paper support having provided thereon 100 mg Ag/m² of a silver chlorobromide emulsion (silver chloride content: 70 mol %) and $4.0 \times 10^{-3}$ mol/m² of a coupler dispersion prepared by dissolving 1-(2,4,6-trichlorophenyl)-3-{5[α-(3-tert-butyl-4-hydroxyphenoxy)-tetradecanamido]-2-chloroanilino}-5-pyrazolone (magenta coupler) in tricresyl phosphate (coupler solvent) and dispersing the solution in a gelatin solution to form an o/w type emulsion using sorbitan monolaurate, Turkey red oil and sodium dodecylbenzenesulfonate (as emulsifying and dispersing agents), was prepared. The photographic element was exposed using a sensitometer and subjected to the following processings.

| | | |
|---|---|---|
| Processing Steps: | | |
| Development | 31° C | 1 min |
| Intensification | " | 1 min |
| Bleach-fixing | " | 2 min |
| Washing | " | 1 min |
| Stabilizing | " | 30 sec |
| composition of each processing solution: | | |
| Developer | | |
| Sodium Tetrapolyphosphate | | 2.0 g |
| Benzyl Alcohol | | 15 ml |
| Sodium Sulfite | | 2 g |
| Hydroxylamine Sulfate | | 2 g |
| Potassium Bromide | | 0.5 g |
| 4-Amino-N-ethyl-N-(β-methanesulfonamidoethyl)-m-toluidine sesquisulfate monohydrate | | 10 g |
| Water to make | | 1 liter |

Intensifier

| Intensifier | Composition | | |
|---|---|---|---|
| | $NaBrO_2$ | $Na_2CO_3 \cdot (H_2O)$ | pH |
| | g/l | g/l | |
| e | 0 | 10 | 11.0 |
| f | 10 | " | " |
| g | 40 | " | " |
| h | 160 | " | " |
| Bleach-fixing Solution / Stabilizing Solution | Same as in Example 11. | | |

The photographic properties obtained are shown in Table 10.

Table 10

| Intensifier | Photographic Property Fog | Max. Density |
|---|---|---|
| e | 0.06 | 1.30 |
| f | 0.07 | 1.55 |
| g | 0.09 | 1.68 |
| h | 0.11 | 2.48 |

From Table 10, it is seen that the maximum density markedly increased as the amount of sodium bromite increased. Also, the results show that the intensifying of the present invention provided excellent effects.

EXAMPLE 14

A photographic element comprising a polyethylene coated paper support having provided thereon 100 mg Ag/m² of a silver chlorobromide emulsion (silver chloride content: 70 mol %) and $3 \times 10^{-3}$ mol/m² of α-pivalyl-2-chloro-4-(4-benzyloxyphenylsulfonyl)-phenoxy-5-[α-(2,4-di-ter-amylphenoxy)butanamido]-acetanilide (yellow coupler) in di-n-butyl phthalate (coupler solvent) and emulsifying the solution in a gelatin solution to form an o/w emulsion using sorbitan monolaurate, Turkey red oil and sodium dodecylbenzenesulfonate (as emulsifying and dispersing agents was prepared. This photographic element was subjected to the same processing as in Example 13.

As the intensifiers, those of the following compositions were used.

| Intensifier | Composition $NaBrO_2$ | $Na_2CO_3(H_2O)$ | pH |
|---|---|---|---|
| | g/l | | |
| i | 0 | 10 | 9.0 |
| j | 0 | " | 11.0 |
| k | 40 | " | 9.0 |
| l | " | " | 11.0 |
| m | " | " | 12.0 |

pH adjustment was effected using sodium hydroxide or sulfuric acid. The results obtained are shown in Table 11.

Table 1

| Intensifier | Photographic Property Fog | Max. Density |
|---|---|---|
| i | 0.05 | 1.41 |
| j | 0.06 | 1.48 |
| k | 0.07 | 1.76 |
| l | 0.08 | 1.87 |
| m | 0.09 | 2.00 |

Table 11 shows that maximum density increased as the pH of the intensifier of the present invention increased. The increase in fog was very low.

EXAMPLE 15

A silver bromide emulsion containing a yellow coupler emulsion dispersion, a silver bromochloride emulsion (silver chloride content: 70 mol %) containing a magenta coupler emulsion dispersion, a silver chlorobromide emulsion (silver chloride content: 70 mol %) containing a cyan coupler emulsion dispersion, and a gelatin layer containing an ultraviolet ray-absorbing agent were coated on a baryta paper to prepare a color paper.

Each coupler emulsion used in this color paper was prepared by dissolving the coupler in a mixture of dibutyl phthalate and tricresyl phosphate and dispersing the same in a gelatin solution to form an o/w emulsion using sorbitan monolaurate, Turkey red oil and sodium doecylbenzenesulfonate as emulsifying agents.

As the couplers, 1-(2',4',6'-trichlorophenyl)-3-[3'-(2'',4''-di-tert-amylphenoxyacetamido)benzamido]-5-pyrazolone (magenta), 1-hydroxy-4-chloro-2-n-dodecylnaphthamide (cyan) and α-(2-methylbenzoyl-)aceto-(2'-chloro-5'-dodecoxycarbonyl)anilide (yellow) were used. As the ultra-violet ray-absorbing agent, compound 1 described in Japanese Patent Publication No. 9,586/70 was used. 2,4-dichloro-6-hydroxy-1,3,5-triazine sodium salt was also added as a hardener.

The coated amounts of the couplers and silver halide were as given below.

| | Amount of Coupler Coated (g/m²) | Amount of Silver Halide Coated(g/Ag/m²) |
|---|---|---|
| Red-sensitive Layer | 0.4 g/m² | 0.02 |
| Green-sensitive Layer | 0.5 g/m² | 0.02 |
| Blue-sensitive Layer | 0.4 g/m² | 0.02 |

The photographic element was exposed using a sensitometer and subjected to the following processings.

| | | |
|---|---|---|
| Processing Steps: | | |
| Development | 31° C | 2 min |
| Intensification | " | 2 min |
| Bleach-fixing | " | 2 min |
| Washing | " | 2 min |
| Stabilizing | " | 30 sec |
| Composition of each processing solution: | | |
| Developer | | |
| Sodium Sulfite | | 2.5 g |
| Potassium Bromide | | 0.5 g |
| 2-Amino-5-diethylamino-toluene Hydrochloride | | 2.5 g |
| Sodium Carbonate Monohydrate | | 30 g |
| Sodium Hydroxide | | 0.5 g |
| Water to make | | 1 liter |

Intensifier

| | Intensifier n | Intensifier 0 |
|---|---|---|
| Sodium Bromite | 0 g | 80 G |
| Sodium Carbonate | 10 g | 10 g |
| Benzyl Alcohol | 10 ml | 10 ml |

Water was added to make 1 liter, and pH was adjusted to 11.0.

| | |
|---|---|
| Bleach-fixing Solution<br>Stabilizing Solution | Same as in Example 11. |

The results thus obtained are shown in Table 12.

Table 12

| Intensifier | Maximum Density R | G | B |
|---|---|---|---|
| n | 0.9 | 1.1 | 1.2 |
| o | 2.3 | 2.3 | 2.1 |

Intensifier (o) in accordance with the present invention markedly increased color density.

EXAMPLE 16

A color negative monolayer film comprising a cellulose acetate support having provided thereon 500 mg Ag/m² of a silver bromoiodide emulsion (silver iodide content: 6 mol %) and $4.0 \times 10^{-3}$ mol/m² of a coupler dispersion prepared by emulsifying and dispersing 1-hydroxy-4-chloro-2-n-dodecylnaphthamide (cyan coupler) as an o/w emulsion, was prepared; the coupler was dissolved in tricresyl phosphate and then dispersed in an aqueous gelatin solution. After exposure with a sensitometer, the element was subjected to the following processings.

| | | |
|---|---|---|
| Processing Steps: | | |
| Color Development | 38° C | 2 min |
| Intensification | " | 2 min |
| Bleaching | " | 6 min and 30 sec |
| Washing | " | 3 min and 15 sec |
| Fixing | " | 6 min and 30 sec |
| Washing | " | 3 min and 15 sec |
| Stabilizing | " | 1 min and 30 sec |
| Drying | | |
| Composition of each processing solution: | | |
| Color Developer | | |
| Sodium Tetrapolyphosphate | | 2.0 g |
| Sodium Sulfite | | 2.0 g |
| Sodium Carbonate (monohydrate) | | 30 g |
| Potassium Bromide | | 2.0 g |
| Hydroxylamine Sulfate | | 3.0 g |
| 3-Methyl-4-amino-N-ethyl-N-β-hydroxyethylaniline Sulfate | | 5.0 g |
| Water to make | | 1 liter |
| Intensifier | | |
| Sodium Carbonate | | 10 g |
| Sodium Bromite | | 40 g |
| Water to make | | 1 liter |
| pH: adjusted to 11.0 | | |
| Bleaching Solution | | |
| Ammonium Bromide | | 150 g |
| Aqueous Ammonia | | 5 ml |
| Iron(III)-Sodium Ethylenediamine-tetraacetate | | 100 g |
| Water to make | | 1 liter |
| Fixing Solution | | |
| Sodium Tetrapolyphosphate | | 2.0 g |
| Sodium Sulfite | | 15 g |
| Ammonium Thiosulfate (70% Solution) | | 150 ml |
| Water to make | | 1 liter |
| Stabilizing Solution | | |
| Formaldehyde (37% Solution) | | 5.0 ml |
| Water to make | | 1 liter |

As a result of the above processing, there was obtained a good cyan image having high maximum density and low fog.

EXAMPLE 17

A light-sensitive material comprising a polyethylene terephthalate support having provided thereon 1 g Ag/m² of a high speed silver bromoiodide gelatin emulsion (silver iodide: 1 mol %) and $8 \times 10^{-3}$ mol/m² of 5-[α-(2,4-di-tert-amylphenoxy)-hexamido]-2-heptafluorobutylamidophenol (cyan coupler) emulsion dispersion was prepared; the coupler was dissolved in tricresyl phosphate and then dispersed in an aqueous gelatin solution. The light-sensitive material was sandwiched between two sheets of a fluorescent intensifying foil having a calcium tungstatecontaining layer and image-wise exposed to X-rays through an aluminum step wedge. The material was then subjected to the following processings.

| | | |
|---|---|---|
| Processing Steps: | | |
| Color Development | 35° C | 30 sec |
| Intensification | " | 1 min and 30 sec |
| Washing | " | 15 sec |
| Fixing | " | 30 sec |
| Washing | " | 45 sec |
| Composition of each processing solution: | | |
| Color Developer | | |
| Sodium Hexametaphosphate | | 1 g |
| Sodium Sulfite | | 2 g |
| 1-Phenyl-3-pyrazolidone | | 0.5 g |
| Potassium Bromide | | 1 g |
| Sodium Carbonate (monohydrate) | | 50 g |

-continued

| | |
|---|---|
| Hydroxylamine Sulfate | 2 g |
| N,N-Diethyl-p-phenylenediamine Hydrochloride | 6 g |
| Water to make | 1 liter |
| Intensifier | |
| Sodium Carbonate Monohydrate | 20 g |
| Sodium Bromite | 100 g |
| Water to make | 1 liter |
| (pH adjusted to 11.5 with sodium hydroxide) | |
| Fixing Solution | |
| Same as that of Example 16. | |

As a result, there was obtained a good image (cyan color image plus silver image) having high maximum density and low fog.

While the invention has been described in detail and with reference to specific embodiments thereof, it will be apparent to one skilled in the art that various changes and modifications can be made therein without departing from the spirit and scope thereof.

What is claimed is:

1. In an image-forming method which comprises contacting with an intensifying agent in the presence of a reducing agent, a photographic element comprising a support having thereon at least one layer containing image-wise distributed catalyst nuclei and thereby image-wise oxidizing the reducing agent and conducting image intensification, the improvement comprising using chlorite, chlorous acid, an aqueous solution of chlorine dioxide having a pH of 8 to 13, bromite or bromous acid as said intensifying agent.

2. The image-forming method of claim 1, wherein said intensifying agent is at least one member selected from the group consisting of sodium chlorite, potassium chlorite, sodium bromite, and potassium bromite.

3. The image-forming method of claim 1, wherein said intensifying agent is incorporated in a processing solution.

4. The image-forming method of claim 3, wherein said processing solution is an intensifying bath having a pH of 8 to 13.

5. The image-forming method of claim 4, wherein said intensifying solution contains an organic anti-fogging agent.

6. The image-forming method of claim 1, wherein the reducing agent is present in a processing solution.

7. The image-forming method of claim 1, wherein the reducing agent is present in the photographic element.

8. The image-forming method of claim 3, wherein said intensifying agent is incorporated into an intensifying solution and said photographic element is contacted with said processing solution after development and before silver-bleaching.

9. The image-forming method of claim 3, wherein said intensifying agent is incorporated into a developer solution.

10. The image-forming method of claim 3, wherein said intensifying agent is present in an amount of 0.01 to 6 mols per liter.

11. The image-forming method of claim 7, wherein said reducing agent is present in a light-sensitive emulsion layer or in a layer adjacent to a light-sensitive emulsion layer.

12. The image-forming method of claim 4, wherein said image-wise distributed catalytic nuclei is the latent image formed upon exposure of a light-sensitive silver salt.

13. The image-forming method of claim 1, wherein the image-wise distributed catalytic nuclei are partly or completely reduced silver formed upon developing an exposed light-sensitive silver salt.

14. The image-forming method of claim 12, wherein said silver salt is a silver halide.

15. The image-forming method of claim 14, wherein said light-sensitive silver salt is present in an amount of not more than 5 $g/m^2$.

16. The image-forming method of claim 12, wherein the photographic element comprises mutli-layered emulsions and the silver is present in an amount of not more than 2 $g/m^2$.

17. The image-forming method of claim 16, wherein the coated silver amount is 1 $mg/m^2$ to 1 $g/m^2$ per layer.

18. The image-forming method of claim 1, wherein said reducing agent is a primary aromatic amine developing agent.

19. The image-forming method of claim 18, wherein said primary aromatic amine developing agent is N,N-diethyl p-phenylenediamine, 2-amino-5-(N-ethyl-N-laurylamino)-toluene, 4-[N-ethyl-N-(β-hydroxyethyl-)amino]aniline, 2-methyl-4[N-ethyl-N-(β-hydroxyethyl-)amino]aniline, N-ethyl-N-(β-methanesulfoamidoethyl)-3-methyl-4-aminoaniline, N-(2-amino-5-diethylaminophenylethyl)-methanesulfonamide, N,N-diethyl-p-phenylenediamine, 4-amino-3-methyl-N-ethyl-N-methoxyethylaniline, 4-amino-3-methyl-N-ethyl-N-β-ethoxyethylaniline or 4-amino-3-methoxy-N-ethyl-N-(β-butoxyethyl) aniline.

20. The image-forming method of claim 1, wherein said photographic element contains a coupler.

21. The image-forming method of claim 1, wherein said image-wise distributed catalyst nuclei are noble metal catalyst nuclei.

22. The method of claim 1, wherein the photographic element contains a coupler in said layer containing image-wise distributed catalyst nuclei or in an adjacent layer.

23. The image-forming method of claim 1, wherein said coupler is present in an amount by weight equivalent to or more than that of the silver present.

24. The image-forming method of claim 23, wherein said photographic element contains a coupler solvent in the layer containing said coupler.

* * * * *